United States Patent [19]

Kropac

[11] 3,955,975

[45] May 11, 1976

[54] MANIFOLD IMAGING MEMBER AND PROCESS EMPLOYING A METAL SOAP

[75] Inventor: Joseph M. Kropac, Williamson, N.Y.

[73] Assignee: Xerox Corporation, Stamford, Conn.

[22] Filed: Mar. 28, 1974

[21] Appl. No.: 455,760

[52] U.S. Cl. ..... 96/1 M; 96/1.5

[51] Int. Cl.[2] ..... G03G 13/22

[58] Field of Search ..... 96/1 M, 1.5, 1.3; 117/17.5

[56] References Cited

UNITED STATES PATENTS

| | | | |
|---|---|---|---|
| 3,438,904 | 4/1969 | Wagner | 252/62.1 |
| 3,598,581 | 8/1971 | Reinis | 96/1 M |
| 3,625,747 | 12/1971 | Kaneko | 96/1.5 |
| 3,707,368 | 12/1972 | Van Dorn | 96/1 M |

*Primary Examiner*—David Klein

*Assistant Examiner*—John L. Goodrow

[57] ABSTRACT

A manifold imaging method and member is disclosed wherein the imaging layer comprises electrically photosensitive materials, a binder and a metallic soap. Such imaging layers have been found to be more easily activated or rendered structurally fracturable in response to the combined effects of an applied electric field and exposure to electromagnetic radiation to which the imaging layer is sensitive when employed in the manifold imaging process.

20 Claims, No Drawings

MANIFOLD IMAGING MEMBER AND PROCESS EMPLOYING A METAL SOAP

BACKGROUND OF THE INVENTION

This invention relates to the manifold imaging process and more particularly to a novel manifold imaging member and method.

The manifold imaging process is most typically practiced by employing electrically photosensitive materials dispersed in electrically insulating binder materials. The process is more generally described in U.S. Pat. No. 3,707,368 to Van Dorn. As is therein taught the imaging layer is electrically photosensitive and in one form comprises electrically photosensitive material such as metal-free phthalocyanine dispersed in an insulating binder. Typically, the imaging layer is coated on a donor layer and the coated substrate combined is termed a donor. When needed, in preparation for the imaging operation, the imaging layer is activated as by contacting it with a swelling agent, softening agent, solvent or partial solvent for the imaging layer. The imaging layer is typically exposed to an imagewise pattern of light to which it is sensitive and while sandwiched between the donor and receiver layers and subjected to an electric field the imaging layer fractures upon the separation of the donor and receiver layers. Upon fracture complementary positive and negative images are found on the donor and receiver layers in accordance with the image to which it was exposed.

As is taught in the aforementioned patent to Van Dorn the imaging layer is typically activated by applying thereto an activator material. There are several methods of activation known in the prior art not only as taught by Van Dorn but also as disclosed in U.S. Pat. No. 3,598,581 to Reinis. The amount of activator and the time required for activation varies widely depending upon the materials employed in the imaging layer such as a binder, the thickness of the imaging layer and the ability of the activator to soften or weaken the imaging layer.

For purposes of handling, shipping and storing the imaging layer; use of the activation step has been found to be advantageous. Thus, an otherwise non-fracturable imaging layer is rendered fracturable shortly before use in the imaging process. However, a readily convertable imaging layer from non-fracturable to fracturable is greatly desired to both shorten the time required for activation and to reduce the operating parameters of activation by any activation means.

SUMMARY OF THE INVENTION

It is therefore an object of this invention to provide an improved manifold imaging method.

Another object of this invention is to provide a novel imaging member useful in the manifold imaging process having a wider latitude of activation capability when being activated by any mode.

Another object of this invention is to provide a manifold imaging member having an imaging layer more easily activated.

In accordance with this invention there is provided a manifold imaging member and method employing a metal soap incorporated into the imaging layer. The metal soap is incorporated into the imaging layer easily during the preparation of the layer by simply mixing the metal soap with the other ingredients such as by mixing it with the electrically photosensitive material prior to the addition of the binder material. However, the metal soap of this invention is included in the imaging layer by several means such as mixing it with the binder material or the electrically photosensitive material in such a manner that it is uniformly dispersed throughout the layer.

Typical, metallic soaps useful in the member and method of this invention are soaps of fatty acids such as stearic, naphthenic, octoic resinates or tall oil with heavy metals such as aluminum, calcium, cobalt, copper, manganese, nickel, tin and preferably zinc and mixtures thereof. As in the prior art of manifold imaging, care must be taken to employ more purified forms of metal soaps so that the imaging layer does not become sufficiently conductive to destroy the electrical field which must be placed across the imaging layer at the time of imaging and separation of the donor and receiver layers.

A wide range of concentrations of metal soaps have been found effective in the method of this invention. Accordingly, one may find effective as little as about 1 percent by weight of total solid material including pigment and binder in the imaging layer up to in the range of from about 50 to about 60 percent. The only limitation is that the imaging layer be maintained electrically insulating as it is believed that an excessive amount of metal soap in the imaging layer will render it too conductive for use in the manifold imaging process. In addition structural integrity is endangered at very high concentrations of metal soap.

In inclusion of metal soaps in accordance with this invention has been found to be most useful in manifold imaging layers employing thermoplastics resin binders although its use is not limited thereto. The inclusion of metal soaps of this invention in the manifold imaging layer is found to enable prior art activators to more easily render the imaging layer frangible. That is, the layer is rendered sufficiently weak structurally so that the application of applied field combined with the action of actinic radiation on the electrically photosensitive materials will fracture the imaging layer. The step of rendering the imaging layer structurally weak is termed "activation." Further the layer must respond to the application of field, the strength of which is below the field strength which will cause the electrical breakdown or arcing across the imaging layer. Another suitable term for this physical property therefor would be "field fracturable."

The aforementioned U.S. Pat. No. 3,707,368 to Van Dorn fully describes representative compounds and materials which can be employed in forming the manifold imaging member and is therefore incorporated herein by reference. For purposes of example, the following materials are representative. The donor substrate or layer and the receiver layer may consist of either electrically conductive or preferably electrically insulating materials. Typical materials include aluminum foil, cellophane, polyethylene, polyethyleneteraphthylate available from the E. I. DuPont Co. Inc. under the trade name "Mylar," cellulose acetate, paper, plastic coated paper such as polyethylene coated paper and mixtures thereof. Suitable activating fluids, i.e., swelling agents, softening agents, solvents and partial solvents may include any material which will reduce the cohesive strength of the imaging layer. Typical materials include kerosene, petroleum ether, silicone oils mineral oils and preferably hydrocarbon fractions such as Sohio Odorless Solvent 3440 available from the Standard Oil Company. As in the prior art the activator is preferably purified to remove any conductive materials so that the electrically insulating nature of the imaging layer is preserved.

In addition, thermal activation is useful in the process and member of this invention. Typical thermal activation technique is fully disclosed in U.S. Pat. No. 3,598,581 to Reinis which patent is incorporated herein by reference. Typical thermoactivators are low melting waxes including octadecane, nonadecane, eicosane, henicosane, docosane, tricosane, terphenyls, chlorinated polyphenyls such as Araclor 5442 available from Monsanto Co., polybutylenes, byphenyl and mixtures thereof. The liquid activator is typically placed in contact with the imaging layer shortly before the actual imaging process takes place. The above mentioned thermoactivators are incorporated into the manifold imaging members as by providing a solid layer of the thermoactivator between the donor and imaging layer or between the imaging layer and the receiver layer. The thermoactivator may be placed in the imaging member by hot melt or dispersion coating techniques. In use the thermoactivator is heated whereby it melts and activates the imaging layer.

The binder material in the imaging layer may comprise any suitable electrically insulating material. Such materials include resins particularly the lower molecular weight polyethylenes, polystyrene, polyamides, microcrystalline wax, paraffin wax, polybutelenes and other such materials as disclosed in the aforementioned and incorporated Van Dorn patent.

In the manifold imaging process the imaging layer is subjected to an electrical field as described in the prior art such as in the above-mentioned Van Dorn patent. Typical electrical fields are in the range of from about 2,000 volts to about 7,000 volts per mil of insulating material in the imaging member. The electrical field can be applied in many ways. Generally, the imaging member comprising the donor layer, the imaging layer and the receiver layer is placed between electrodes having a potential difference. Also, an electrical charge can be imposed upon one or both of the donor and receiving sheets before or after forming the sandwich by any one of several known methods for inducing a static electrical charge into a material. Static charges can be imposed by contacting the sheet or substrate with an electrically charged electrode. Alternatively, one or both sheets may be charged using corona discharge devices such as those described in U.S. Pat. Nos. 2,588,699 to Carlson; 2,777,957 to Walkup or 2,885,556 to Gundlach all of which are hereby incorporated by reference.

Thus the electrical field can be provided by means known to the art for subjecting an area to an electrical field. In the process of this invention wherein the donor or receiver layer is composed of conductive material each may also be employed as the electrodes by which the imaging layer is subjected to an electrical field. In those instances wherein at least one of the donor layer and receiver layer is subjected to a static charge to provide the electrical field across the imaging layer such static charge is extended across the imaging layer at least at the time the imaging member is separated. Accordingly, a donor can be electrostatically charged as described in the above-mentioned patents and the imaging layer exposed prior to being covered by a receiver layer. The potential is then extended across the imaging layer at the time of separation conveniently by providing a conductive backing on each side of the manifold imaging member and electrically interconnecting the backings. Such a method is more fully described in U.S. Pat. No. 3,615,393 to Krohn et al hereby incorporated by reference.

Any suitable source of electromagnetic radiation may be employed to expose the imaging layer of this invention. The electrically photosensitive material is chosen so as to be responsive to the wavelength of the electromagnetic radiation employed. It is to be noted that different electrically photosensitive materials have different spectral responses and that the spectral response of many electrically photosensitive materials may be modified, increased, or narrowed by means known to the art. In addition, more than one electrically photosensitive material can be employed simultaneously in the imaging layer. Quite obviously, the materials employed in the donor and receiver layers are transparent to the appropriate electromagnetic radiation acting upon the imaging layer when the operative mode of the process requires the exposure of the imaging layer while it resides between the donor and receiver layers. On the other hand, transparency of materials is not required in the manifold imaging member since the imaging layer can be exposed prior to being sandwiched between the donor and receiver layers.

In another embodiment of this invention the imaging layer also contains sub-microscopic hydrophobic silica. Any suitable hydrophobic finely divided silica can be employed, such silica is commercially available under various tradenames and generally has a particle size in the range of from about 2 to about 30 millimicrons. Examples of such silicas are Silanox 101 and Organo-Sil available from the Cabot Chemical Co., Boston, Mass. and Aerosil R-972 available from Degussa Inc., New York, N.Y. Other similar silica products can be employed in accordance with this invention. Hydrophobic silica is a specially prepared product from silicon dioxide. A more complete description as several exemplary materials is found in U.S. Pat. No. 3,720,617 to Chaterji et al., which patent is hereby incorporated by reference.

The above described silica forms a gel with organic solvents such as Sohio Odorless Solvent 3440 and the gel layer is incorporated into the imaging member in any suitable means as by mixing it with the binder materials during fabrication of the layer. Depending upon the desired rigidity of the gel, amounts of from about 5 to about 10 percent by weight based upon the imaging layer have found to be suitable in most instances.

DESCRIPTION OF THE PREFERRED EMBODIMENTS

The following examples further specifically illustrate the various embodiments of the improved member and method. The parts and percentages are by weight unless otherwise indicated.

EXAMPLES I–V

Five imaging layers are prepared by providing five batches of pigment comprising x-form metal-free phthalocyanine as described in Example I of the aforementioned U.S. Pat. No. 3,707,368. About 2.5 grams of the x-form phthalocyanine is added to 1.2 grams of Algol yellow GC, 1,2,5,6-di-(C,C′-diphenyl)-thiazoleanthraquinone, C. I. No. 67300, available from General Analine and Film Corp. and about 2.8 grams of purified Irgazine Red, 2 BLT available from Geigy Chemical Co. The mixture is milled in a ball mill for four hours with 60 ml. DC naphtha 2032, a hydrocarbon solvent. To the mixture there are added varying amounts of zinc stearate. In Example I, 0.14 grams is added, in Example II, 1.4 grams is added, in Example III, 3.5 grams is added and in Example IV, 7 grams is added. A control, Example V is also prepared containing no zinc stearate.

Five batches of binder material are prepared by first dissolving three parts of polyethylene DYLT, 1.5 parts of Paraflint RG, 0.5 parts of Elvax 420 and 2.5 parts of Piccotex 75 in 20 ml. of Sohio Odorless Solvent 3440 by heating the mixture with stirring. The solution is allowed to cool and the resulting paste added to the milled pigment containing, in Examples I–IV, varying amounts of zinc stearate. The pigment/paste mixture is ball milled for about 16 hours. The milled mixture is then placed in a polyethylene jar which is heated in a water bath at a temperature 65°C for about two hours. The paste is then allowed to cool and slurried with about 70 parts of 2-propanol. The paste-like mixture is then coated on a 1 mil thick Mylar sheet with a No. 22 wire-wound draw-down rod. The coating on the Mylar is then dried for three minutes at a temperature in the range of from about 43° to about 45°C.

On each of the five imaging layers there is placed a one mil Mylar receiver sheet. Each imaging member is then imaged by first lifting the receiver and activating the imaging layer by the application of a small amount of Sohio Odorless Solvent 3440 by means of a brush. The activated imaging layer is again sandwiched between the donor and receiver sheets and placed between a pair of electrodes connected to a 9,000 volt power supply. The donor is resting upon the conductive coating of the transparent glass electrode which electrode is connected to the positive pole of the power supply and a conductive rubber electrode is placed over the receiver layer. While subjected to the electric field the imaging layer is exposed to imagewise radiation from an incandescent light source for 0.5 seconds at a stop of *f* 11. With the power supply still connected the electrodes and receiver is separated from the donor, where upon the imaging layer fractures in imagewise configuration in each instance. It is found that as the concentration of the zinc stearate increases the fragility of the imaging layer also increases thus allowing the imaging layer to fracture more easily upon separation of the donor and receiver sheets.

EXAMPLE VI

The procedure of Example III is repeated with the exception that the zinc stearate is replaced by an equal amount of manganese stearate. Similar results are obtained.

EXAMPLE VII

The procedure of Example IV is repeated with the exception that the only pigment present is the *x*-form metal-free phthalocyanine. Similar results are obtained.

EXAMPLE VIII

The procedure of Example III is repeated with the exception that manganese octoate is employed in place of zinc stearate. Similar results are obtained.

EXAMPLE IX

The procedure of Example II is repeated with the exception that zinc stearate is replaced by the calcium soap of 2-ethylhexoic rosin. Similar results are obtained.

EXAMPLE X

The procedure of Example III is repeated with the exception that the imaging member is provided with a thermoactivator by coating the dried imaging layer with a layer of a paraffin wax obtained from the Will Scientific Co., Rochester, N.Y. under the trade name Bioloid Embedding Compound. The coating is provided by first dispensing 54 grams of the melted wax in about 300 ml of an alcohol mixture of 5% isopropanol, 5% methanol and 90% ethanol at room temperature with constant stirring. The dispersion is milled at room temperature overnight at 125 rpm in a 500 ml polyethylene bottle one-half filled with ¼ inch stainless steel pellets, Type 440 from the Pioneer Steel Ball Co., Unionville, Conn. The balls are previously cleaned with several washes of benzene and acetone. The thus prepared dispersion is coated over the imaging layer by means of a No. 28 wire wound draw down rod. The thermoactivator layer is fused at 75°C for 15 minutes. In the imaging process the imaging layer is activated by heating the imaging layer to about 54° C melting the thermoactivator. The imaging layer is easily activated to provide a pair of images upon separation of the donor and receiver layers.

What is claimed is:

1. A manifold imaging member comprising a donor layer having coated thereon an electrically photosensitive imaging layer comprising an electrically photosensitive material, an electrically insulating binder material and from about 1 percent to about 60 percent by weight of a metal soap and residing upon said imaging layer a receiver layer, at least one of said donor and receiver layers being at least partially transparent to electromagnetic radiation to which said imaging layer is sensitive.

2. The imaging member of claim 1 wherein said metal soap is a zinc soap.

3. The imaging member of claim 2 wherein the soap is zinc stearate.

4. An imaging member of claim 1 wherein the donor layer is transparent.

5. An imaging member of claim 1 wherein the metal soap concentration is in the range of about 25 percent.

6. An imaging member of claim 1 wherein the metal soap is selected from the group consisting of stearate, naphthenates, octoates and tall oil derivatives.

7. A manifold imaging member comprising a donor layer having coated thereon an imaging layer comprising an electrically photosensitive material, an electrically insulating binder material and from about 1 percent to about 60 percent by weight of a metal soap, a thermoactivator layer residing upon said imaging layer and a receiver layer residing upon said thermoactivator layer, at least one of said donor and receiver layers being at least partially transparent to electromagnetic radiation to which said imaging layer is sensitive.

8. An imaging member of claim 7 wherein said thermoactivator is a low melting paraffin wax.

9. An imaging member of claim 7 wherein said soap is zinc stearate.

10. The manifold imaging process which comprises the steps of:

a. providing an imaging member comrising a donor layer, an imaging layer comprising an electrically photosensitive material, an electrically insulating binder material and from about 1 percent to about 60 percent of a metal soap, and residing on said imaging layer a receiver layer, at least one of said donor and receiver layers being at least partially transparent to electromagnetic radiation to which said imaging layer is sensitive;

b. activating said imaging layer so as to render it structurally fracturable in response to the combined effects of an applied electric field and exposure to electromagnetic radiation;

c. subjecting said imaging layer to an electrical field and exposing said imaging layer to electromagnetic radiation to which it is sensitive, and;

d. separating said donor and receiver layers while said imaging layer is subjected to an electric field whereby said imaging layer fractures in imagewise configuration providing a positive image of the original on one of said donor and receiver layers and a negative image on the other layer.

11. The process of claim 10 wherein said metal soap is zinc stearate.

12. The method of claim 10 wherein said metal soap is present in the range of about 25 percent.

13. The method of claim 10 wherein said electrical field is in the range of from about 2,000 volts to about 7,000 volts per mill of electrically insulating material in said member.

14. The method of claim 10 wherein said activation step is performed by applying a thermoactivator to said imaging layer and heating said activator above its melting point.

15. The method of claim 14 wherein at least one of said donor and receiver layers are electrically insulating and said electric field is supplied by static charges in at least one of said donor and receiver layer.

16. The member of claim 1 wherein said imaging layer additionally contains from about 5 percent to about 10 percent by weight of said imaging layer of a gel formed by mixing a hydrophobic silica with an organic solvent.

17. The member of claim 7 wherein said imaging layer additionally contains from about 5 percent to about 10 percent by weight of said imaging layer of a gel formed by mixing a hydrophobic silica with an organic solvent.

18. The method of claim 10 wherein said imaging layer additionally contains from about 5 percent to about 10 percent by weight of said imaging layer of a gel formed by mixing a hydrophobic silica with an organic solvent.

19. The imaging member of claim 16 wherein said imaging layer contains a metal soap concentration in the range of about 25 percent.

20. The method of claim 18 wherein the metal soap concentration is in the range of about 25 percent.

* * * * *